US006570545B1

(12) United States Patent
Snow et al.

(10) Patent No.: US 6,570,545 B1
(45) Date of Patent: May 27, 2003

(54) APPARATUS AND PROCESS FOR REFLECTING RADAR WAVES

(75) Inventors: Jeffrey M. Snow, Bloomington, IN (US); Charles W. Tennant, Linton, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/945,679

(22) Filed: Dec. 6, 2001

(51) Int. Cl.[7] ..... H01Q 15/14
(52) U.S. Cl. ..... 343/915; 343/912; 342/8
(58) Field of Search ..... 343/915, 912, 343/916; 342/5, 6, 7, 8, 9, 10; H01Q 15/14, 15/18

(56) References Cited

U.S. PATENT DOCUMENTS

| | | | | | |
|---|---|---|---|---|---|
| 2,463,517 | A | | 3/1949 | Chromak | 343/915 |
| 2,534,716 | A | | 12/1950 | Hudspeth | 342/8 |
| 2,888,675 | A | | 5/1959 | Pratt | 342/8 |
| 3,276,017 | A | | 9/1966 | Mullin | 343/915 |
| 3,671,965 | A | * | 6/1972 | Rabenhorst et al. | 343/915 |
| 4,673,934 | A | | 6/1987 | Gentry | 342/8 |
| 4,901,081 | A | * | 2/1990 | Bain, Jr. et al. | 342/8 |
| 4,980,688 | A | * | 12/1990 | Dozier, Jr. | 342/9 |
| 5,457,472 | A | | 10/1995 | Bjordal | 343/912 |

* cited by examiner

*Primary Examiner*—Hoanganh Le
(74) *Attorney, Agent, or Firm*—Crane L. Lopes, Esq.

(57) ABSTRACT

A polyhedral-shaped inflatable structure having substantially continuous inner and outer flexible surfaces is inflatable with air or gas so that a radar reflector, comprising a plurality of conterminous corner reflectors, is thereby positioned within the inflatable structure to reflect radar waves. The corner reflectors are preferably made of metallized reflective plastic film attached to a plurality of support filaments. Support members attached to the support filaments are pivotally disposed adjacent to the inner flexible surface to position the radar reflector within the inflatable structure. Removable fasteners are disposed adjacent to the outer flexible surface and concentrically proximate to the support members to thereby fasten the radar reflector to the inflatable structure without puncturing the inner and outer flexible surfaces. The radar reflector may be manually repositioned while the inflatable structure is inflated by removing the fasteners, repositioning the radar reflector, and refastening the fasteners concentrically proximate to the support members.

20 Claims, 5 Drawing Sheets

APPARATUS AND PROCESS FOR REFLECTING RADAR WAVES

STATEMENT REGARDING FEDERAL SPONSORED RESEARCH OR DEVELOPMENT

The invention claimed and disclosed herein may be manufactured and used by, or on behalf of, the Government of the United States of America for government purposes without the payment of any royalties thereon or therefor.

REFERENCE TO A MICROFICHE APPENDIX

Not Applicable.

CROSS-REFERENCE TO RELATED APPLICATIONS

Not Applicable.

BACKGROUND OF THE INVENTION

The present invention relates generally to radar reflectors, and more particularly to a lightweight radar reflector comprising a plurality of conterminous corner reflectors, wherein the radar reflector is adjustably supported and positioned within an inflatable structure when the inflatable structure is inflated with air, gas or lighter-than-air gas.

In the past, corner radar reflectors, which typically consist of three planar surfaces suitable for reflecting radio frequency waves and connected together at right angles to each other, have been utilized for a number of military and commercial purposes. When radio frequency waves, emitted towards the radar reflector within a range of angles relative to the reflector center, strike the reflector they reflect directly back toward the source of emission. Consequently, a radar transceiver receiving such reflected radio frequency waves will indicate that the radar cross-section of the detected radar reflector is much bigger than the reflector actually is. Because of this feature, namely the ability to indicate a large radar cross-section relative to actual size, corner-type radar reflectors find particular applicability in military and industrial uses as floating and aerial radar decoys and beacons.

Disposing a collapsible radar reflector within an inflatable structure is particularly efficacious because the combined apparatus may be folded or otherwise compacted for storage using a minimum of storage space. Past radar reflectors have been constructed of lightweight materials to improve ease of handling and storage, and to enable the apparatus to float in the atmosphere when inflated with lighter-than-gas. In operation, such radar reflector apparatus are typically inflated with air, gas or a combination thereof so that as the inflatable structure inflates it imparts force to the radar reflector disposed therein in a manner to position the radar reflector to reflect radar waves when the inflatable structure is fully inflated. The inflatable structure may then, depending upon relative weight of the gas it is inflated with, be employed as an aerial or surface radar decoy or beacon. In the past, such decoys or beacons have typically been deployed as aerial radar beacons floating above terrain, or floating on the surface of the sea as ship radar decoys.

Past apparatus having an inflatable structure with a radar reflector disposed therein have, however, suffered from several disadvantages. For instance, when in use the effect of wind and other environmental forces upon the outer surface of the inflatable structure often imparts torsional and other forces to the radar reflector disposed within such that the shape of the radar reflector is thereby distorted. The ability of the radar reflector to optimally reflect radar waves is substantially degraded. Therefore, past apparatus lack the ability to effectively isolate the radar reflector supported within the inflatable structure from the effect of environmental forces imparted to the outer surface of the inflatable structure.

Another disadvantage of past inflatable structures with a radar reflector disposed therein has been that the radar reflector is affixed to the inflatable structure by a process that requires puncturing the surfaces of the inflatable structure. Such a process of affixation is detrimental to the structural integrity of the inflatable structure, and encourages leakage when the inflatable structure is inflated with air or gas. When the air or gas leaks out, the inflatable structure deflates and the radar reflector's positioning to reflect radar waves is degraded. Therefore, past systems that include processes of affixing the radar reflector to the inflatable structure that require puncturing the surfaces of the inflatable structure are inherently disadvantageous.

Still another disadvantage of past inflatable structures with a radar reflector disposed therein has been that there is no method for a user to easily adjust the position of the radar reflector within the inflatable structure when the structure is inflated. As discussed previously, past radar reflector apparatus have been manufactured so that the apparatus may be folded or otherwise compacted for storage or transportation using a minimum of storage space. The radar reflector of past apparatus is typically permanently attached to the inner surface of the inflatable structure during manufacture. Due to the rigors of prolonged storage, the inflatable structure may not inflate to its intended symmetrical shape when it is inflated. Instead, the inflatable structure may inflate asymmetrically. Consequently, the radar reflector, which depends on such symmetrical inflation to optimally position it within the inflatable structure is not properly positioned within the non-uniform, inflated structure. Past radar reflector apparatus typically lack a convenient method for the user to manually adjust the position of the radar reflector within the inflatable structure after the structure has been inflated.

Yet another disadvantage of past inflatable structures with a radar reflector apparatus disposed therein has been that the shape of the inflatable structure is not conducive to securely positioning the radar reflector within the inflatable structure. Past apparatus typically use a spherical-shaped inflatable structure. While such a structure lends itself to uniform inflation, it does not provide any substantially planar surfaces upon which to affix the radar reflector within the structure. Consequently, the radar reflector is prone to being dislodged out of an optimal position to reflect radar waves when the apparatus is in use.

Information relevant to attempts to address these problems can be found in U.S. Pat. No. 2,463,517 (Chromak), U.S. Pat. No. 2,534,716 (Hudspeth et al.), U.S. Pat. No. 2,888,675 (Pratt et al.), U.S. Pat. No. 3,276,017 (Mullin), U.S. Pat. No. 4,673,934 (Gentry et al.) and U.S. Pat. No. 5,457,472 (Bjordal et al.). However, each one of these references suffers from one or more of the following disadvantages:

- U.S. Pat. No. 2,463,517 (Chromak) does not disclose a means for a user to conveniently adjust the position of the radar reflector within the inflatable structure when the structure is inflated. Chromak also does not teach an inflatable structure having a plurality of planar surfaces.
- U.S. Pat. No. 2,534,716 (Hudspeth et al.) does not disclose a means for a user to conveniently adjust the position of the radar reflector within the inflatable structure when the structure is inflated. Hudspeth also does not teach a means to effectively isolate the radar reflector supported within the inflatable structure from the effect of environmental forces imparted to the outer surface of the inflatable structure.

U.S. Pat. No. 2,888,675 (Pratt et al.) does not teach an inflatable structure having a plurality of planar surfaces. Further, Pratt does not disclose a means for a user to conveniently adjust the position of the radar reflector within the inflatable structure when the structure is inflated. Pratt also does not teach a means to effectively isolate the radar reflector supported within the inflatable structure from effect of environmental forces imparted to the outer surface of the inflatable structure.

U.S. Pat. No. 3,276,017 (Mullin) does not disclose a means for overcoming asymmetric inflation of the inflatable structure. In addition, Mullin does not teach a means for adjusting of the positioning of the corner reflector support members without disassembling the entire apparatus. Further, because the support members of Mullin are permanently attached to the inner surface of the inflatable structure, there is a risk that the corner reflector could tear the inflatable structure, thus degrading the utility of the apparatus as a radar reflector.

U.S. Pat. No. 4,673,934 (Gentry et al.) does not teach an inflatable structure having a plurality of planar surfaces. Further, Gentry does not disclose a means for a user to conveniently adjust the position of the radar reflector within the inflatable structure when the structure is inflated.

U.S. Pat. No. 5,457,472 (Bjordal et al.) does not teach an inflatable structure having a plurality of planar surfaces. Further, Bjordal does not disclose a means for a user to easily adjust the position of the radar reflector within the inflatable structure when the structure is inflated.

In contrast, the invention disclosed herein overcomes these disadvantages by using a polyhedral-shaped inflatable structure having a plurality of planar faces. A radar reflector is positioned and supported within the inflatable structure using means that effectively isolate the radar reflector from the effect of environmental forces upon the support members of the radar reflector when the invention is in use. The radar reflector disclosed by this invention is positioned and supported within the inflatable structure without necessity to resort to puncturing the inflatable structure in any manner. The present invention discloses a convenient process for fastening the radar reflector to the inflatable structure, whereby a user may expeditiously adjust the position of the radar reflector within the inflatable structure while the structure is inflated.

For the foregoing reasons, there is a need for an apparatus and process for reflecting radar waves wherein the apparatus uses a radar reflector that is supported and positioned with an inflatable structure so as to effectively isolate the radar reflector from the effects of environmental forces on the inflatable structure when the structure is inflated.

Also for the foregoing reasons, there is a need for an apparatus and process for reflecting radar waves wherein a radar reflector, disposed within an inflatable structure, may be conveniently repositioned within an inflatable structure while the inflatable structure is inflated.

SUMMARY OF THE INVENTION

The present invention is directed to an apparatus and process that satisfies the need for a radar reflector that is positioned land supported within an inflatable structure so as to effectively isolate the radar reflector from the effects of environmental forces on the inflatable structure when the structure is inflated. The present invention is further directed to an apparatus and process wherein a radar reflector, disposed within an inflatable structure, may be conveniently unfastened, repositioned, and refastened to the inner surface of the inflatable structure while the inflatable structure is inflated.

Therefore, an object of the present invention is to disclose a means of positioning and supported a radar reflector within an inflatable structure so that the radar reflector is effectively isolated from the effects of environmental forces on the inflatable structure when the structure is inflated.

Another object of the present invention is to disclose a means for a user to conveniently unfasten, reposition, and refasten a radar reflector within an inflatable structure when the structure is inflated.

A still further object of the present invention is to provide a means for positioning and supporting a radar reflector within an inflatable structure without puncturing the surfaces of the inflatable structure.

One other object of the present invention is to disclose an apparatus for reflecting radar waves wherein a polyhedral-shaped inflatable structure having a plurality of planar surfaces is used to support and position a radar reflector therein.

An object of the present invention is to provide a low-cost apparatus for reflecting radar waves, wherein the apparatus is lightweight and compact when not inflated.

Yet another object of the present invention is to provide an apparatus for reflecting radar waves wherein the inflatable structure is operable to rotate about an axis in response to environmental forces impinging upon the structure, and thereby causing the radar cross-section of the apparatus to fluctuate.

An apparatus for reflecting radar waves, in accord with the present invention, comprises an inflatable structure that has a substantially continuous inner flexible surface and an outer flexible surface so that the inflatable structure may be inflated with air, gas or lighter-than-air gas. At least one radar reflector is disposed within the inflatable structure. Support members are coupled to the radar reflector to support the radar reflector within the inflatable structure. The support members are disposed adjacent to the inner flexible surface so that the support members cooperate to position the radar reflector to reflect radar waves when the inflatable structure is inflated. Fasteners are disposed adjacent to the outer flexible surface of the inflatable structure, and the fasteners may be placed concentrically proximate about the support members to thereby fasten the radar reflector to the inflatable structure.

Preferably, each of the support members comprises a base member pivotally connected by a hinge to a fastening member so that the fastening member is pivotally disposed adjacent to the inner flexible surface of the inflatable structure when the inflatable structure is inflated.

In accord with one aspect of the present invention, each of the fasteners includes an annular band of elastomeric material.

As another aspect, the fasteners are disposed concentrically proximate about the fastening members so that the radar reflector is fastened to the inner surface of the inflatable structure.

In accord with another aspect of the present invention, the inflatable structure may be polyhedral-shaped, with a plurality of planar faces when the inflatable structure is inflated.

One other aspect of the present invention is that the inflatable structure may be cube-shaped, with six planar faces when the inflatable structure is inflated.

Another aspect of the present invention is that the radar reflector may comprise a corner reflector made of metallized plastic film and attached to a plurality of support filaments. The support filaments are attached to the support members.

Still another aspect of the present invention may include eight corner reflectors, conterminously connected together within the inflatable structure.

An apparatus for reflecting radar waves, in accord with the present invention, comprises a polyhedral-shaped inflatable structure that has a substantially continuous inner flexible surface and an outer flexible surface so that said inflatable structure may be inflated with air, gas or lighter-than-air gas. A radar reflector is disposed within the polyhedral-shaped inflatable structure. The radar reflector comprises eight conterminous corner reflectors of metallized reflective plastic film attached to a plurality of support filaments. Six support members adjustably couple the radar reflector to the inner flexible surface of the inflatable structure. Each fastening member further comprises a base member attached to the support filaments at a first end and pivotally connected by a hinge to a fastening member at a second end so that said radar reflector is positioned to reflect radar waves when the inflatable structure is inflated. Six fasteners are disposed adjacent to the outer flexible surface of the polyhedral inflatable structure. Each of the fasteners may be adjustably disposed concentrically proximate about each of the fastening members so that said radar reflector is thereby fastened to the inner surface of the inflatable structure when the inflatable structure is inflated.

A process for reflecting radar waves, in accord with the present invention, comprises positioning at least one radar reflector within an inflatable structure, fastening the radar reflector to the inner flexible surface of the inflatable structure, and repositioning the radar reflector within the inflatable structure so that that position of the radar reflector within the inflatable structure may be adjusted without deflating the inflatable structure.

Preferably, the act of positioning the radar reflector includes supporting the radar reflector within the inflatable structure by a plurality of support filaments.

In accord with another aspect of the present invention, fastening the radar reflector to the inflatable structure includes pivotally disposing the radar reflector adjacent to an inner surface of the inflatable structure.

Also preferably, the act of adjusting the radar reflector includes unfastening fasteners, disposed adjacent to an outer surface of the inflatable structure and concentrically proximate about support members of the radar reflector, repositioning the radar reflector within the inflatable structure, and refastening the fasteners adjacent to the outer surface and concentrically proximate to the radar reflector so that said reflector is thereby refastened to the inner flexible surface of the inflatable structure.

The apparatus and process of the present invention, using a radar reflector positioned and supported within an inflatable structure by pivotable support members disposed adjacent to the inner flexible surface of said structure, thus effectively isolate the radar reflector from environmental forces impinging upon the inflatable structure when the invention is in use. The disclosed apparatus and process of the present invention further permits convenient unfastening, repositioning, and refastening of the radar reflector within the inflatable structure without requiring the inflatable structure to be deflated.

BRIEF DESCRIPTION OF THE SEVERAL VIEWS OF THE DRAWINGS

These and other features, aspects and advantages of the present invention will become better understood with regard to the following description, appended claims and accompanying drawings where:

DETAILED DESCRIPTION OF THE INVENTION

Figure 1:
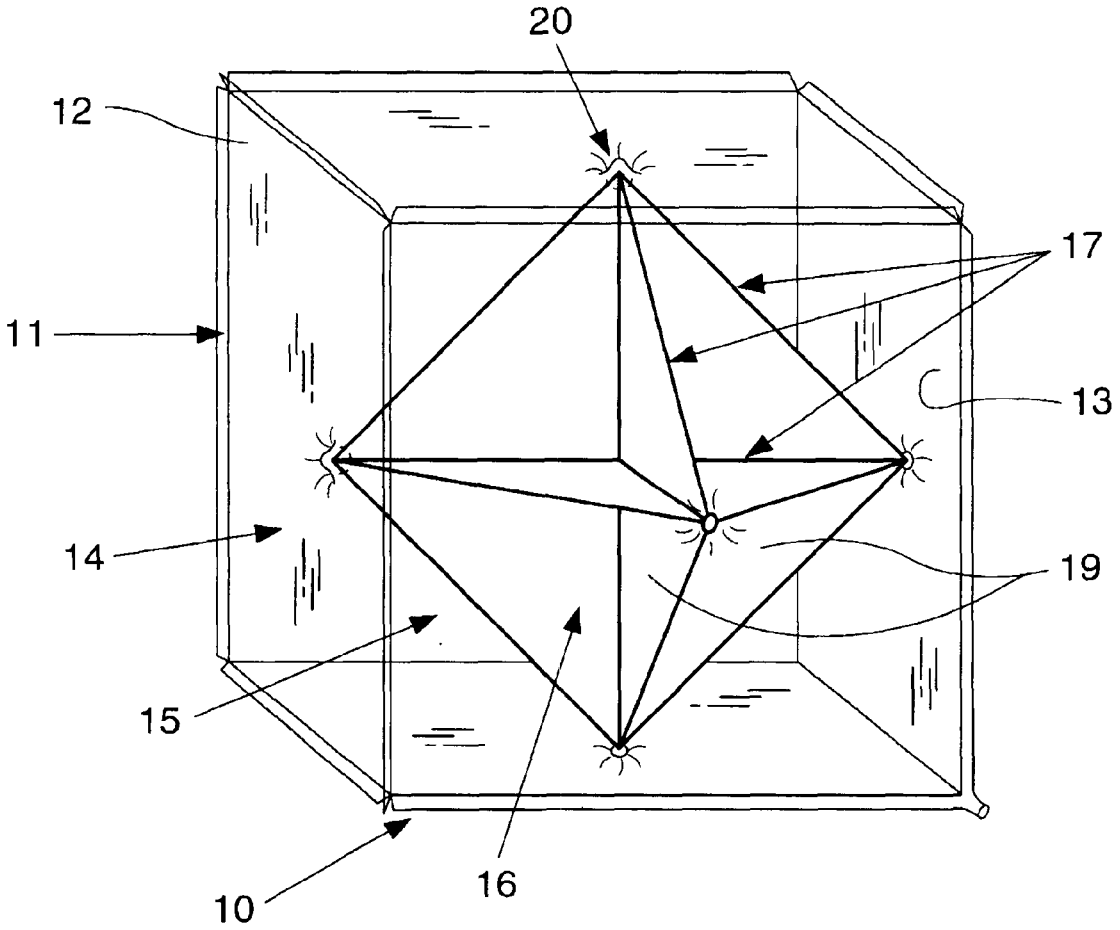
FIG. 1 shows a perspective view of the apparatus for reflecting radar waves in accordance with the present invention.

As shown in FIG. 1, an apparatus for reflecting radar waves 10 comprises an inflatable structure 11, wherein a radar reflector 15 made of metallized plastic film 19 is disposed within inflatable structure 11. Radar reflector 15 comprises a plurality of conterminous corner reflectors 16 that are positioned and supported within inflatable structure 11 by a plurality of support filaments 17. Support filaments 17 cooperate with a plurality of support members 20 to fasten radar reflector 15 to an inner flexible surface 13 of inflatable structure 11. Inflatable structure 11 may be inflated with air, gas or lighter-than-air gas, thereby causing planar faces 14 to expand and thereby impart tensional forces to each of support members: 25 and support filaments 17 so that radar reflector 15 is optimally positioned to reflect radar when inflatable structure 11 is inflated.

Referring further to FIG. 1, inflatable structure 11 is preferably inflatable by air, gas or lighter-than-air gas to form a polyhedral-shaped structure having a plurality of planar faces 14, whereby the planar faces 14 form substantially continuous inner flexible surface 13 and an outer flexible surface 12. Inflatable structure 11 is illustrated as having a cube-shape, with six planar faces 14, when inflated. Alternatively, however, inflatable structure 11 may be any polyhedral shape, with a number of planar faces 14 corresponding to the polyhedral.

In the preferred embodiment, inflatable structure 11 is made of a non-stretch or low-stretch thin film material such as polyethylene terephthalate or its equivalent. However, metallized plastic film 19 may be replaced by an equivalent lightweight material suitable for reflecting radar waves.

Referring further to inflatable structure 11 of FIG. 1 and as disclosed above, said structure may be any polyhedral shape suitable for the use required, provided that support members 20 are disposed so that radar reflector 15 is positioned and supported within inflatable structure 11 when said structure is inflated.

Inflatable structure 11 functions to protect radar reflector 15 from damage during storage and from environmental forces when the present invention is in use. Inflatable structure 11 also functions in cooperation with support members 20 so that radar reflector 15 is optimally positioned to reflect radar waves when the present invention is in use. Further, when inflated with air, gas or lighter-than-air gas as depicted by FIG. 1, inflatable structure 11 functions to enable the present invention to float in the atmosphere or upon the sea, depending upon the relative weight of the inflation gas compared to the weight of the local atmosphere.

Radar reflector 15 comprises sections of metallized plastic film 19 attached to support filaments 17. Preferably, attachment is accomplished by adhesive, heat-sealing or similar mechanical means. Support filaments 17 and metallized plastic film 19 form a plurality of triangular structures of metallized plastic film 19, conterminously joined together to form a plurality of corner reflectors 16. As shown in FIG. 1, each of corner reflectors 16 consist of three triangular structures of metallized plastic film 19 joined together at right angles to each other.

The function of radar reflector 15 is to reflect radar waves emitted towards the radar reflector back toward the source of emission. Radar reflector 15 is illustrated as comprising eight conterminous corner reflectors 16. Alternatively, however, radar reflector 15 may be comprised of any number of corner reflectors 16, and such alternative structures may be employed to adjust the tendency of radar reflector 15 to reflect radar waves.

Referring again to FIG. 1, support filaments 17 may comprise monafilament, lightweight and low-stretch string, fiber, filament, line or equivalent materials. In the preferred embodiment of the present invention, support filaments 17 are arranged within inflatable structure 11 so said filaments define the shape of an eight-sided polyhedron, comprising the eight corner reflectors 16 of metallized plastic film 19 disclosed supra.

As disclosed supra, when radio frequency waves emitted towards radar reflector 15 within a range of angles relative to said reflector center strike said reflector they reflect directly back toward the source of emission. Due to the fewer number of corner reflectors 16, and to the effective viewing-angle nature of corner reflectors in general, as inflatable structure 11 rotates in response to wind striking the exterior vanes, the indicated radar cross-section of inflatable structure 11 will tend to vary from relatively small to relatively large depending upon the rotational speed of corner reflectors 16. Thus, the radar cross-section of the radar reflector will appear to "fluctuate." Such a fluctuating radar cross-section characteristic may be advantageously exploited for a variety of purposes known in the art, for example by military users to degrade enemy radar performance.

In the preferred embodiment of the present invention, the function of metallized plastic film 19 is to provide a suitable surface for reflecting radar waves. The function of support filaments 17 is to support radar reflector 15 within the inflatable structure when said structure is inflated. Support filaments and metallized plastic film 19 together form a plurality of corner reflectors 16, said corner reflectors in turn comprising radar reflector 15.

Radar reflector 15 is fastened to inflatable structure 11 by a plurality of support members 20. In the preferred embodiment of the present invention, support members 20 are disposed adjacent to the inner flexible surface 13 of the center of each of planar faces 14. Thusly, FIG. 1 illustrates six support members 20, each support member 20 being disposed in the center of one of the six planar faces 14 of the cube-shaped inflatable structure 11. Support filaments 17 are coupled to support members 20 so that radar reflector 15 is positioned and supported within inflatable structure 11 when said structure is inflated.

Figure 2:
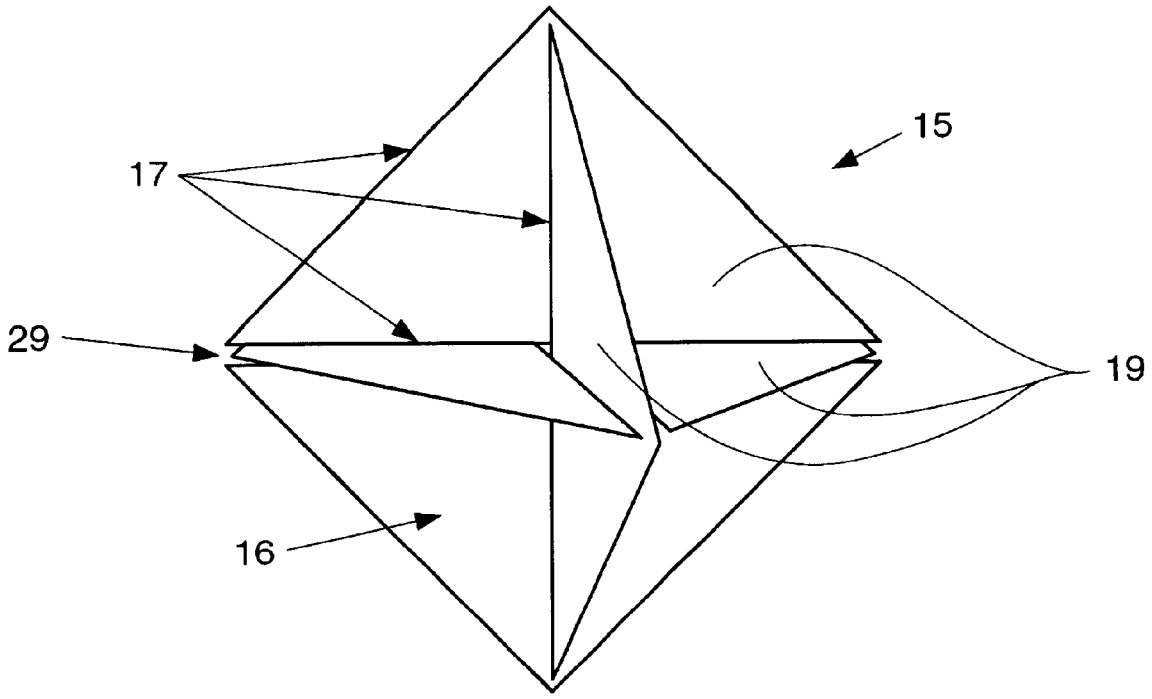
FIG. 2 shows a perspective view of the radar reflector of FIG. 1 in accordance with the present invention.

FIG. 2 shows a perspective view of the radar reflector 15 of FIG. 1, illustrating how radar reflector 15 of the preferred embodiment of the present invention is made. In the preferred embodiment, radar reflector 15 comprises eight corner reflectors 16 connected together by support filaments 17 such that radar reflector 15 has the three-dimensional diamond-shaped appearance illustrated by FIG. 2.

During assembly, radar reflector 15 comprises three diamond-shaped planar structures of metallized plastic film 19 fastened to support filaments 17. Each planar structure further comprises a pair of adjoining isosceles triangles, and in the preferred embodiment each pair of such isosceles triangles includes a cut-out strip 29 formed between apexes and bases of the adjoining isosceles triangles of the diamond-shaped planar structure so that direction of cut-out strip 29 is normal to the direction of the baselines of the triangles. Each diamond-shaped planar structure is coupled to each other diamond-shaped planar structure by fitting each structure through cut-out strip 29 of each of the other structures, and then fastening the three assembled diamond-shaped planar structures together so that the eight corner reflectors 16 of radar reflector 15 shown in FIG. 2 are thereby formed.

Referring concurrently to FIG. 1 and FIG. 2 and in view of the disclosure supra, those skilled in the art will appreciate that radar reflector 15 is positioned approximately within the center of inflatable structure 11 when said structure is inflated. The three diamond-shaped planar structures comprising the eight corner reflectors 16 intersect at the center of radar reflector 15. Consequently, the diamond-shaped planar structures of radar reflector 15 intersect at the center of inflatable structure 11.

Because a multiplicity of metallized plastic film 19 must be supported at the center of radar reflector 15, and therefore approximately at the center of inflatable structure 11, in the preferred embodiment at least two parallel support filaments 17 pass through the center of the inflatable structure between each pair of support members 20 adjacent to opposite planar faces of inflatable structure 11. Therefore, in the preferred embodiment illustrated by FIG. 1, three sets of parallel support filaments 17 connect six support members 20.

The function of disposing parallel support filaments 17 to pass through the center of inflatable structure 11 is to provide several support filaments upon which to attach the multiplicity of sections of metallized plastic film 19 that intersect at the center of radar reflector 15. Alternatively, each set of at least two parallel support filaments 17 extending through the center of the inflatable structure 11 may be replaced with a single support filament 17. However, in this alternative embodiment of the present invention, a greater number of edges of metallized plastic film 19 would necessarily have to be fastened to each of single support filaments 17 than if at least two parallel support filaments 17 are used.

Similarly, while the radar reflector 15 of FIG. 2 is illustrated as including three diamond-shaped planar structures each consisting of two adjoining isosceles triangles of metallized plastic film 19, alternatively a greater number of such planar structures and triangles may be employed to form the corner reflectors 16 of radar reflector 15. For example, six diamond-shaped planar structures, consisting of twelve triangles, may be used to form radar reflector 15. In such an alternative embodiment of the present invention, it may be preferable for two or more support filaments 17 to extend through the center of inflatable structure 11 between support members adjacent of opposite sides of inflatable structure 11. As in the preferred embodiment of the present invention, using two parallel support filaments 17 will provide more places upon which to fasten metallized plastic film 19 than if a single support filament 17 is used.

Figure 3A:
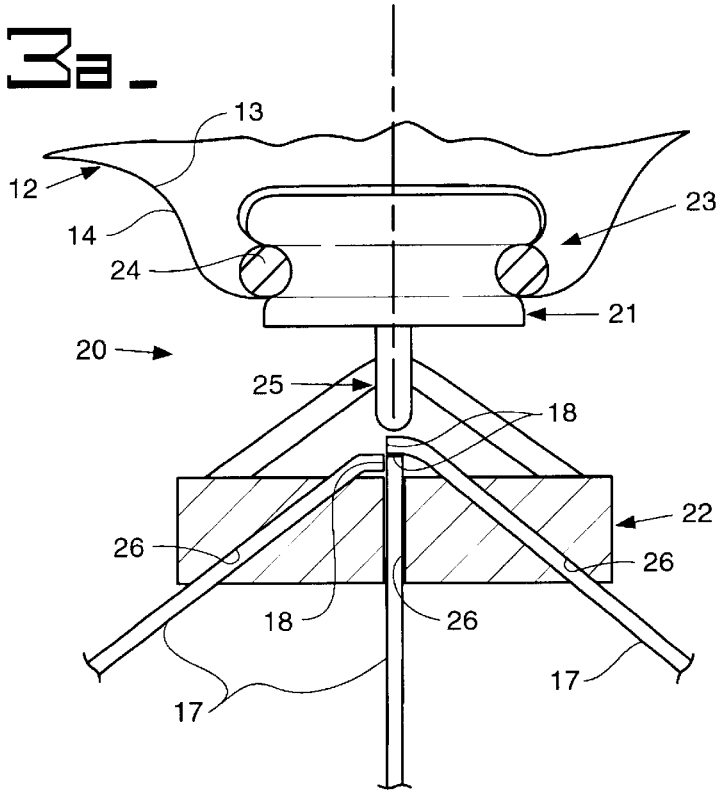
FIGS. 3(*a*)–3(*b*) shows front and side partial sectional views of a support member fastened to the inflatable structure in accordance with the present invention.
Figure 3B:
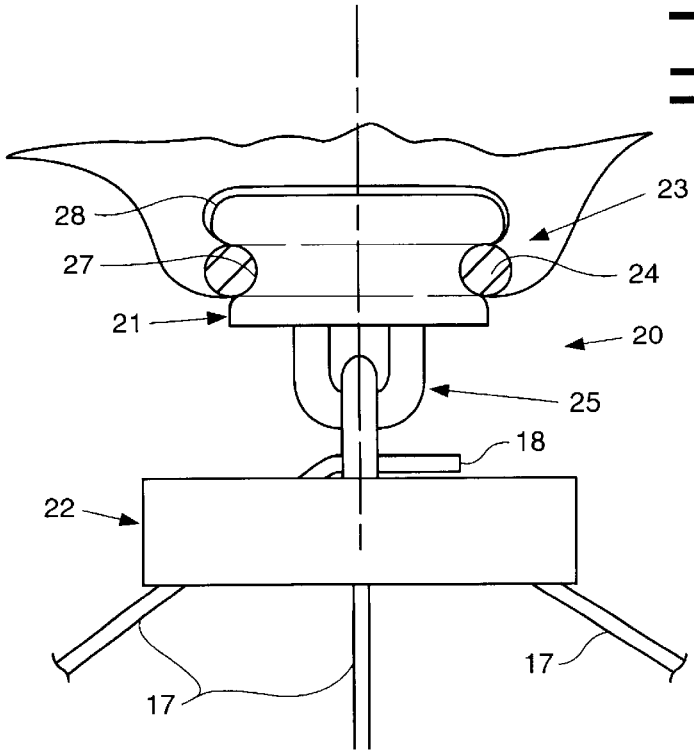

FIGS. 3(*a*)–3(*b*) shows front and side partial-sectional views of support member 20 fastened to inflatable structure 11 in accordance with the present invention. Support member 20 comprises a base member 22 coupled to a fastening member 21 by a hinge 25. Base member 22 preferably includes several passages 26 formed therein, said passages 26 being formed within base member 22 to receive an end 18 of each of support filaments 17. Support filaments 17 are attached to base member 22 by passing end 18 of each of support filaments 17 through passages 26 and then securing ends 18 of each of support filaments 17 to each other by knotting, adhesives or by similar mechanical means. Therefore, a function of each base member 22 is to provide a single point for securing a number of ends 18 support filaments 17 together.

As further depicted by FIGS. 3(*a*)–3(*b*), base member 22 is coupled to fastening member 21 by hinge 25 so that fastening member 21 is thereby pivotally disposed adjacent to inner flexible surface 13 of planar face 14 of inflatable structure 11. In the preferred embodiment of the present invention, hinge 25 is coupled to base member 22 so that hinge 25 is positioned axially proximate to the intersection of the tension forces imparted by support filaments 17 up on base member 22 when the present invention is in use. Accordingly, hinge 25 functions to prevent support member 20 from twisting axially in response to torsional forces imparted by support filaments 17 upon base member 22.

Fastening member 21 is, by the action of hinge 25, pivotally disposed adjacent to inner flexible surface 13 of inflatable structure 11 by large-diameter portion 28 of fastening member 21. Large-diameter portion 28 is rounded in form so that no sharp corners of radar reflector 15 contact inner flexible surface 13, thereby reducing the chance of punctures to inflatable structure 11. Therefore, a function of fastening member 21 is to ensure that degradation of the effectiveness of radar reflector 15 is not caused due to leaks in, or tears of, inflatable structure 11.

Fastening member 21 is coupled to inner flexible surface 13 of planar face 14 of inflatable structure 11 by fastener 23. Preferably, each fastener 23 includes an elastomeric band 24 so that fastener 23 may be disposed concentrically proximate about small-diameter portion 27 of fastening member 21. Preferably, elastomeric band 24 is annular-shaped and made of an elastic material such as lightweight rubber or plastic. Alternatively, an adhesive or mechanical fastener may be used in place of fastener 23 and elastomeric band 24. For example, a spring-loaded clip is a suitable mechanical fastener alternative.

Yet another alternative to support member 20 shown in FIGS. 3(*a*)–3(*b*), is to tie ends 18 of support filaments 17 together into a knot after ends 18 are passed through passages 26 of base member 22. In this alternative embodiment, the knot replaces hinge 25 and fastening member 21, and the knot is disposed adjacent to inner flexible surface 13 of inflatable structure 11. Elastomeric band 24 of fastener 23 is placed adjacent to outer flexible surface 12 so that elastomeric band 24 is disposed concentrically proximate about the knot, thereby frictionally fastening the knot to inner flexible surface 13.

To secure fastening member 21 to inner flexible surface 13, elastomeric band 24 of fastener 23 is placed adjacent to outer flexible surface 12 and concentrically proximate about fastening member 21 so that elastomeric band 24 is disposed nearby small-diameter portion 27 of fastening member 21. Fastener 23 and fastening member 21 are thereby positioned in relation to each other so that a portion of planar surface 14 of inflatable structure 11 is frictionally disposed between fastener 23 and fastening member 21, thereby fastening support member 20 to inner flexible surface of inflatable structure 11.

Therefore, FIGS. 3(*a*)–3(*b*) shows that fastening member 21 and fastener 23 may be positioned so that fastener 21, including elastomeric ring 24, functions to fasten fastening member 21 to inner flexible surface 13 of inflatable structure 11. Fastener 21 is coupled to base member 22 by hinge 25, and base member 22 functions as a securing point for support filaments 17 of radar reflector 15. Thusly, radar reflector 15 is pivotally positioned within inflatable structure 11 by means obviating the need to puncture planar faces 14, and by means enabling radar reflector 15 to remain optimally positioned within inflatable structure 11 when said structure is inflated.

Figure 4:
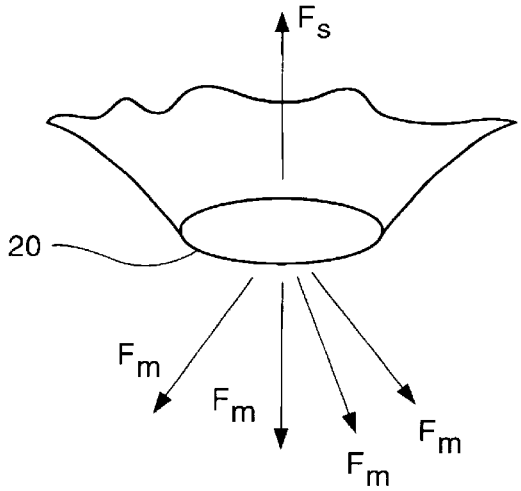
FIG. 4 shows a schematic force diagram showing vectors representing forces acting upon the inflatable structure in accordance with the present invention.

FIG. 4 shows a schematic force diagram depicting vectors representing forces acting in vicinity of support member 20 when inflatable structure 11 is inflated in accordance with the present invention. Referring to FIG. 1, FIGS. 3(*a*)–3(*b*) and FIG. 4, the length of support filaments 17 and the size of inflatable structure 11 are proportionate. Thusly, the expansion force ($F_s$) exerted by inflatable structure 11 when it is inflated are approximately equal and opposite to the tension forces ($F_m$) imparted to support filaments 17 and support member 20.

Since support member 20 is coupled to planar faces 14 of inflatable structure 11 by the means described supra, each of planar faces 14 will tend to bulge outward (in the direction depicted by $F_s$ of FIG. 4), and thereby tension support filaments 17 so as to support and position radar reflector 15 within inflatable structure 11. Therefore, support filaments 17 and inflatable structure 11 are proportionately sized to each other so that radar reflector 15 is positioned within inflatable structure 11 by inflation forces acting upon support filaments 17 and support members 20 when inflatable structure 11 is inflated.

Each of hinges 25 of support members 20 functions to desensitize radar reflector 15 to the effects of asymmetrical inflation of inflatable structure 11 because hinge 25 pivots support member 20 in response to asymmetrical inflation forces to keep radar reflector 15 optimally positioned within inflatable structure 11 when said structure is inflated. This advantage of the present invention is considerably enhanced because the present invention permits radar reflector 15 to be unfastened, repositioned, and refastened to inflatable structure 11 without requiring deflation of inflatable structure 11.

Figure 5:
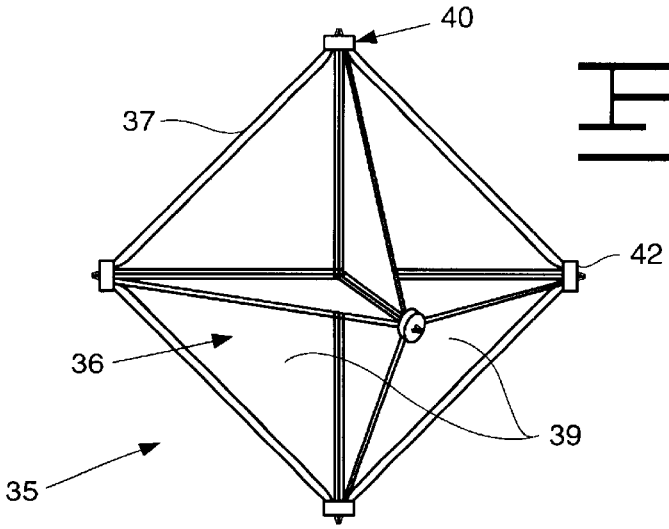
FIG. 5 shows a perspective view of an alternative embodiment of the support members of the radar reflector in accordance with the present invention.

FIG. 5 shows a perspective view of an alternative embodiment of the radar reflector 35 in accordance with the present invention. As shown by FIG. 5, radar reflector 35 discloses an alternative means for coupling radar reflector 35 to support member 40. As disclosed supra, support filaments 37 of the illustrated alternative embodiment extend between a plurality of support members 40 upon which metallized plastic film 39 may be attached to form a plurality of corner reflectors 36. In this alternative embodiment of the present invention, however, metallized plastic film 39 is not attached to support filaments 37. Instead, metallized plastic film 39 is attached to each fastener 42 of support members 40.

Figure 6:
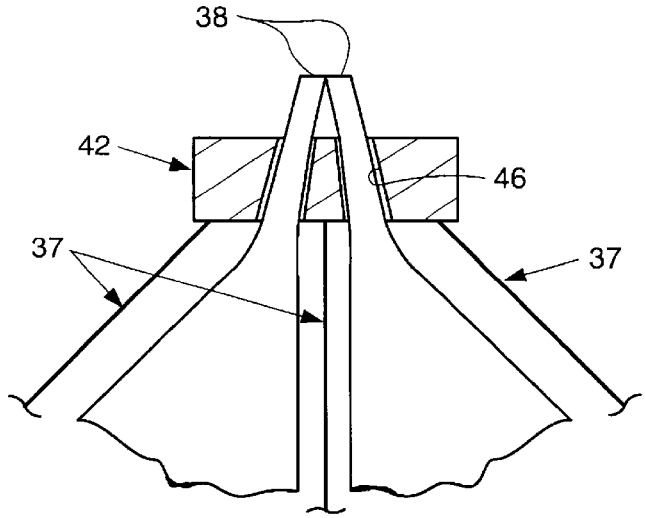
FIG. 6 shows a front elevation, full sectional view of an alternative embodiment of a fastener in accordance with the present invention.

FIG. 6 shows a front elevation, full sectional view of an alternative embodiment of a fastener 42 of FIG. 5. FIG. 6 shows how film tabs 38 of metallized plastic film 39 are directly attached to each of fasteners 42 instead of to support filaments 37. Preferably, each of film tabs 38 of several sections of metallized plastic film 39 are passed though a film passage 46 formed within fastener 42. Film tabs 38 are then secured together or to fastener 42 in any suitable manner such as by adhesive, stapling or similar mechanical means.

By comparing FIG. 5 and FIG. 6 to FIGS. 3(*a*)–3(*b*), those skilled in the art will appreciate that fastener 42 of FIG. 5 and FIG. 6 performs the same function as fastener 23 and elastomeric band 24 of FIGS. 3(*a*)–3(*b*). Accordingly, fastener 42 is disposed adjacent to outer flexible surface 12 of inflatable structure 11 so that radar reflector 35 may be fastened to inflatable structure 11 without puncturing any of planar faces 14 of said structure. Similarly, by disposing fasteners 42 to outer flexible surface 12, a user may reposition radar reflector 35 when the disclosed alternative embodiment of the present invention is used.

Referring further to FIG. 5 and FIG. 6, those skilled in the art will discern that film tabs 38 alternatively could be attached directly to the inner flexible surface of the inflatable structure by a suitable mechanical means, such as by heat-sealing or adhesives. However, such an alternative means of fastening radar reflector 35 by film tabs 38 within the inflatable structure 11 may restrict the ability to reposition radar reflector 35 within the inflatable structure 11 when the present invention is in use.

Figure 7:
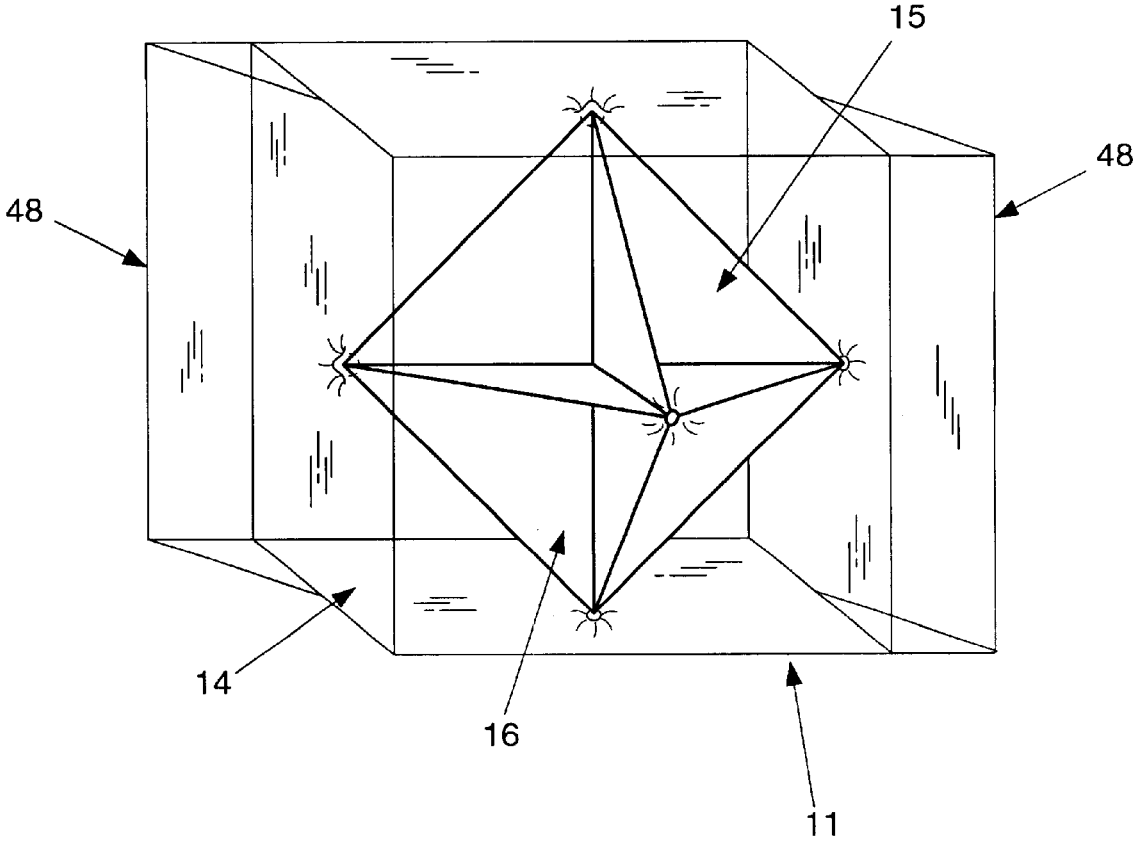
FIG. 7 shows an isometric view of an alternative embodiment of the inflatable structure in accordance with the present invention.

FIG. 7 shows an isometric view of an alternative embodiment of inflatable structure 11 in accordance with the present invention. Exterior vanes 48 may be added to inflatable structure 11 so that said structure may rotate about an axis in response to wind or other environmental forces upon exterior vanes 48 when the invention is in use.

Exterior vanes 48 preferably are made of the same material as inflatable structure 11 and are shaped and are attached to inflatable structure 11 by conventional means such as heat-sealing or gluing. Rotation of inflatable structure 11 varies orientations of the present invention to the radar, thereby causing the radar-cross section to greatly vary.

It will be realized by those skilled in the art that magnitude and duration of such variation of the radar cross section may be changed by providing less or more of corner reflectors 15, or by varying the orientation of corner reflectors 15 within inflatable structure 11. The varying radar cross-section of inflatable structure 11 causes said structure to function as fluctuating-point radar clutter and thereby degrade radar performance.

Therefore, in an alternative embodiment of the invention depicted by FIG. 7, exterior vanes 48 function to enable inflatable structure 11 to rotate about an axis in response to wind or other environmental forces. Inflatable structure will thereby indicate a "fluctuating" radar cross-section to radar receivers transmitting radar waves upon radar reflector 15 when the invention is in use.

Referring again to FIG. 1 and FIGS. 3(*a*)–3(*b*), the preferred embodiment of the present invention is assembled in the following manner. Inflatable structure 11 is typically assembled by positioning radar reflector 15 in a jig so that each of support members 20 is thereby supported in the jig. Then, a portion of a sheet of suitable low-stretch material, such as polyethylene terephthalate, corresponding to a planar face 14, is placed between the jig and one of support members 20 of radar reflector 15. It is preferable to use a low-stretch material for assembling inflatable structure 11 so that the present invention will maintain a consistent shape when in use. However, a material having greater elasticity could alternatively be used for assembling inflatable structure 11.

This process is repeated for each of the support members 20, with adjacent edges of the sheet being attached and sealed to each other by a suitable means, such as by heat-sealing. An extra length of sheet material, such as for a tether or for an inflation nozzle, can be positioned at a seam or corner of inflatable structure 11.

Once inflatable structure 11 is thus assembled, and while said structure and radar reflector are still supported within the jig, elastomeric bands 24 of fasteners 23 are placed adjacent to outer flexible surface 12 and concentrically proximate about fastening members 21 of support members 20, thereby fastening radar reflector 15 to inner flexible surface 13 of inflatable structure 11.

Therefore, the preferred embodiment of the present invention is assembled by placing radar reflector 15 in a jig, attaching and sealing a sheet of low-stretch material about said reflector to form inflatable structure 11, radar reflector 15 is then fastened to inflatable structure 11 by placing fasteners 23 adjacent to outer flexible surface 12 and concentrically proximate about each of support members 20 of radar reflector 15.

Referring to FIG. 1 through FIG. 7 inclusively, the preferred embodiment of the invention is used in the following manner. Once the present invention is assembled by the process described supra, it may be inflated with air, gas or a lighter-than-air gas, such as helium or hydrogen, using any conventional means. Preferably, such conventional means include providing the air or gas from a source independent of the apparatus of the present invention. Alternatively, however, inflatable structure 11 may be modified to include an inflation canister, preferably including an amount of helium, hydrogen or an alternate chemically generated lighter-than-air gas. Such an embodiment of the invention could be deployed deflated, and is configured to automatically inflate either upon impact with water or terrain, or after a certain amount of time has elapsed. Those skilled in the art will appreciate that for such inflation of inflatable structure 11 after passage of a certain amount of time, a timer will preferably be included in the invention and operably connected to the inflation canister to release the contents of the canister into the inflatable structure.

The inflation process causes planar faces 14 of inflatable structure 11 to expand outward and said structure is thereby inflated. Radar reflector 15 is coupled to inner flexible surface 13 of inflatable structure 11 by support filaments 17 connected to support members 20. Therefore, as inflatable structure 11 is inflated, planar faces 14 impart tension forces to support filaments 17 so that radar reflector 15 is positioned and supported within inflatable structure 11 when inflation is completed.

Typically and after the aforementioned inflation is completed, radar reflector 15 is optimally positioned and supported within inflatable structure 11 to reflect radar waves. The force exerted by the inflation gas upon inner flexible surface 13 counterbalances forces thereby imparted to support members 20 and support filaments 17 such that the radar reflector 15 maintains optimal position and shape within inflatable structure 11 to reflect radar waves.

However, due to the rigors of prolonged storage, inflatable structure 11 may not initially inflate to its intended uniform shape when it is inflated. Instead, inflatable structure 11 may initially inflate asymmetrically or radar reflector 15 may not be optimally positioned within said structure after the inflation process is completed. In either case, fasteners 23 may be used to manually adjust the position of radar reflector 15 within inflatable structure 11.

To manually adjust the position of radar reflector 15 within inflatable structure 11, one or a plurality of, fastener 23 is unfastened from nearby support members 20. Radar reflector 15 is thereby unfastened from inner flexible surface 13 of inflatable structure 11. Radar reflector 15 is repositioned by manually manipulating said reflector from outside inflatable structure 11, without needing to deflate said structure. Once radar reflector 15 is repositioned to optimally reflect radar waves, each of fasteners 23 is placed adjacent to outer flexible surface 12 and concentrically proximate about fastening member 21 so that elastomeric band 24 of fastener 23 is disposed nearby small diameter portion 27 of fastening member 21. Fastener 23 and fastening member 21 are thereby positioned in relation to each other so that a portion of planar surface 14 of inflatable structure 11 is frictionally disposed between fastener 23 and fastening member 21.

Therefore, fasteners 23 may be used to reposition radar reflector 15 within inflatable structure 11. Another function of fasteners 23 is to permit a user to reposition radar reflector 15 within inflatable structure 11 so that tension forces upon support filaments 17 are evenly distributed. This is desirable because slack or uneven tension support filaments 17 may, when the present invention is in use, act to distort the planar sections forming corner reflectors 16, thereby degrading the ability of radar reflector 15 to optimally reflect radar waves. It should be appreciated that the adjustment process may be repeated any number of times to adjust the location of any or all of support elements 20 with respect to inflatable structure 11.

Because support filaments 17 and metallized plastic film 19 are preferably made of relatively lightweight materials, the present invention may become a lighter-than-air radar reflector (e.g., the invention may be made to float in the atmosphere) by inflating inflatable structure 11 with a lighter-than-air gas. In addition, because the apparatus of the present invention disclosed supra comprises relatively compact elements, the present invention may be deflated after use and stored flat using a minimum of space.

The preferred embodiment of the present invention may be utilized for a number of useful purposes. For instance, the present invention may be used so that it floats in the atmosphere above the sea to act as a ship decoy. In addition, the present invention may be used as long-term floating radar clutter or for point radar clutter enhancement. When used over land as opposed to over the sea, the present invention may be tethered and used for terrain deception, such as to degrade or confuse terrain following radar or a radar altimeter. Further, the present invention may function as a radar beacon that may float above, or nearby, a life raft.

Referring to FIG. 1 through FIG. 7 inclusively, the previously-described embodiments of the present invention have many advantages including a means of positioning and supporting radar reflector 15 within inflatable structure 11 so that radar reflector 15 is effectively isolated from the effects of environmental forces on inflatable structure 11 when said structure is inflated. Base member 22, hinge 25 and fastening member 21 cooperate to isolate radar reflector 15 from the effects of environmental forces on inflatable structure 11.

The present invention also provides means for a user to conveniently unfasten, reposition, and refasten radar reflector 15 within inflatable structure 11 when said structure is inflated. Fasteners 23 may be removed from concentrically proximate about fastening members 21, thereby permitting the position of radar reflector 15 to be manually adjusted. Fasteners 23 may then be disposed concentrically proximate about fastening members 21, thereby refastening radar reflector 15 to inner flexible surface 13. Further, this process is easily accomplished, since inflatable structure 11 does not have to be deflated to effectuate manual repositioning of radar reflector 15 within inflatable structure 11, nor does the process require puncturing the surfaces of inflatable structure 11.

The present invention advantageously teaches use of an inflatable structure having a polyhedral shape, with a plurality of planar surfaces 14 upon which to support and position radar reflector 15. Planar faces 14 provide advantageous structures (e.g., flat and square) upon which support members 20 may be fastened by fasteners 23 and elastomeric bands 24.

The present invention further provides a low-cost apparatus for reflecting radar waves, wherein the apparatus is lightweight and compact when not inflated. Support filaments 17, metallized plastic film 19 and inflatable structure 11 are preferably made of low-cost lightweight materials so that the present invention is inexpensive to manufacture and may be folded flat for compact storage and ease of transportation when the invention is deflated and not in use.

There accordingly has been described an improved apparatus and process for reflecting radar waves, wherein radar reflector 15, made of metallized plastic film 19, is disposed within inflatable structure 11. Radar reflector 15 is positioned and supported within inflatable structure 11 by a plurality of support filaments 17 that cooperate with a plurality of support members 20 to couple radar reflector 15 to inner flexible surface 13 of inflatable structure 11. Fasteners 23 are disposed adjacent to outer flexible surface 12 and concentrically proximate about fastening members 21 of support members 20 so that radar reflector 15 is thereby adjustably fastened to inflatable structure 11. In use, inflatable structure 11 is inflated with air, gas or lighter-than-air gas, thereby causing planar faces 14 to expand outward, imparting tension forces upon support filaments 17, and thus positioning radar reflector 15 to optimally reflect radar waves when inflation is completed. Radar reflector 15 may be repositioned within inflatable structure 11 by removing fasteners 23 from concentrically proximate about fastening members 21, manually repositioning radar reflector 15, and then refastening fasteners 23 concentrically proximate about fastening members 21, thereby fastening radar reflector 15 to inner flexible surface 13 of inflatable structure 11. The apparatus of the invention may be deployed in the atmosphere or upon the sea for a variety of purposes, including as a radar beacon, radar decoy, for point clutter enhancement, long-term floating clutter or for degrading the performance of terrain following radar or radar altimeters. When not in use, the present invention may be deflated and conveniently stored flat in a minimum of space to facilitate long term storage and transport.

The reader's attention is directed to all papers and documents which are filed concurrently with this disclosure and which are open to public inspection with this specification, and the contents of all such papers and documents are incorporated herein by reference. All the features described in this disclosure (including the accompanying claims, abstract and drawings) may be replaced by alternative features serving the same, equivalent or similar purpose unless expressly stated otherwise. Thus, unless expressly stated otherwise, each feature disclosed is but an example of a generic species of equivalent or similar features. Moreover, any element in a claim that does not explicitly state "means for" performing a specified function or "step for" performing a specific function is not be interpreted as a "means" or "step" clause as specified by 35 U.S.C. 112 ¶ 6. In particular, any use of "step of," "act of" or "acts of" in the claims below is not intended to invoke the provisions of 35 U.S.C. 112 ¶ 6.

In this disclosure, there is shown and described only the preferred embodiment of the invention, but as, aforementioned, it is to be understood that the invention is capable of use in various other combinations and environments and is capable of changes or modifications within the scope of the inventive concept expressed herein.

What is claimed is:

1. An apparatus suitable for reflecting radar waves, the apparatus comprising:

i) an inflatable structure haying a substantially continuous inner flexible surface and an outer flexible surface;

ii) at least one radar reflector disposed within said inflatable structure;

iii) a plurality of support members coupled to said radar reflector, said support members being disposed adjacent to the inner flexible surface of said inflatable structure so that said radar reflector is positioned to reflect radar waves when said inflatable structure is inflated; and iv) a plurality of fasteners capable of being disposed adjacent to the outer flexible surface of said inflatable structure for fastening said radar reflector to the inner flexible surface of said inflatable structure.

2. The apparatus for reflecting radar waves of claim 1, wherein each of said support members includes a base member, pivotally connected by a hinge to a fastening member, so that said support members are thereby pivotally disposed adjacent to the inner flexible surface of said inflatable structure when said inflatable structure is inflated.

3. The apparatus for reflecting radar waves of claim 1, wherein each of said fasteners includes an annular-shaped band of elastomeric material.

4. The apparatus for reflecting radar waves of claim 2, wherein said fasteners are capable of being disposed concentrically proximate about said fastening members so that said radar reflector is thereby fastened to the inner flexible surface of said inflatable structure.

5. The apparatus for reflecting radar waves of claim 4, wherein said fasteners are capable of fastening said radar reflector to said inflatable structure without puncturing the inner flexible surface or outer flexible surface of said inflatable structure.

6. The apparatus for reflecting radar waves of claim 1, wherein said inflatable structure is polyhedral-shaped and forms a plurality of planar faces when said inflatable structure is inflated.

7. The apparatus for reflecting radar waves of claim 6, wherein said inflatable structure is a cube-shaped and forms six planar faces when said inflatable structure is inflated.

8. The apparatus for reflecting radar waves of claim 6, wherein said inflatable structure further includes at least one exterior vane disposed upon the outer flexible surface so that said inflatable structure may rotate about an axis in response to environmental forces impinging upon said exterior vane.

9. The apparatus for reflecting radar waves of claim 1, wherein said radar reflector includes at least one corner reflector made of metallized plastic film attached to a plurality of support filaments, and wherein said support filaments are attached to said support members.

10. The apparatus for reflecting radar waves of claim 9, wherein said support filaments are attached to said support members by knotting.

11. The apparatus for reflecting radar waves of claim 9, wherein said radar reflector includes eight conterminous corner reflectors.

12. The apparatus for reflecting radar waves of claim 9, wherein first ends of at least two of said support filaments are attached to each of said support members, and second ends of said support filaments are attached to support members disposed on the opposite side of the inner flexible surface of said inflatable structure so that said support filaments are disposed substantially through the center of said inflatable structure when said inflatable structure is inflated.

13. The apparatus for reflecting radar waves of claim 12, wherein said support filaments are parallel to each other.

14. A process for reflecting radar waves, the process comprising the acts of:

i) positioning at least one radar reflector within an inflatable structure;

ii) fastening said radar reflector to an inner flexible surface of said inflatable structure; and iii) repositioning said radar reflector within said inflatable structure so that the position of said radar reflector within said inflatable structure may be adjusted without deflating said inflatable structure.

15. The process for reflecting radar waves of claim 14, wherein the act of positioning further includes supporting said radar reflector within said inflatable structure by a plurality of support filaments.

16. The process for reflecting radar waves of claim 14, wherein the act of positioning further includes pivotally disposing said radar reflector adjacent to the inner flexible surface of said inflatable structure.

17. The process for reflecting radar waves of claim 14, wherein the act of fastening further includes fastening said radar reflector by fasteners disposed adjacent to the outer flexible surface of said inflatable structure.

18. The process for reflecting radar waves of claim 17, wherein the act of fastening further includes fastening said radar reflector without puncturing the inner flexible surface of said inflatable structure.

19. The process for reflecting radar waves of claim 14, wherein the act of repositioning further includes the acts of:

i) unfastening a plurality of fasteners disposed adjacent to an outer flexible surface of said inflatable structure to thereby unfasten said radar reflector from the inner flexible surface of said inflatable structure;

ii) adjusting the position of said radar reflector within said inflatable structure;

iii) placing said fasteners adjacent to the outer flexible surface of said inflatable structure; and iv) refastening said fasteners so that said radar reflector is thereby refastened to the inner flexible surface of said inflatable structure.

20. An apparatus suitable for reflecting radar waves, the apparatus consisting of:

i) a polyhedral-shaped inflatable structure having a substantially continuous inner flexible surface and an outer flexible surface so that said inflatable structure may be inflated with gas;

ii) a radar reflector disposed within an inflatable structure, said radar reflector comprising eight conterminous corner reflectors of metallized reflective plastic film attached to a plurality of support filaments;

iii) six support members coupled to said radar reflector and adjustable to fasten said radar reflector to the inner flexible surface of said inflatable structure, each of said support members further comprising a base member attached to said support filaments at a first end and pivotally connected by a hinge to a fastening member at a second end so that said radar reflector is pivotally positioned to reflect radar waves by said support members when said inflatable structure is inflated; and iv) six fasteners disposed adjacent to the outer flexible surface of said inflatable structure, said fasteners further being adjustably disposed concentrically proximate about each of said fastening members so that said radar reflector may thereby be fastened to the inner flexible surface of said inflatable structure.

* * * * *